US008324795B2

(12) United States Patent
Iwase et al.

(10) Patent No.: US 8,324,795 B2
(45) Date of Patent: Dec. 4, 2012

(54) FLUORESCENT LAMP AND LIGHTING INSTRUMENT WITH UNSATURATED MERCURY VAPOR THAT ACHIEVES HIGH BRIGHTNESS AND HIGH TEMPERATURES

(75) Inventors: Keigo Iwase, Yokohama (JP); Yukio Matsuda, Yokohama (JP); Takashi Osawa, Yokohama (JP); Takehiko Sakurai, Yokohama (JP)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 13/144,333

(22) PCT Filed: Dec. 25, 2009

(86) PCT No.: PCT/JP2009/007304

§ 371 (c)(1),
(2), (4) Date: Aug. 30, 2011

(87) PCT Pub. No.: WO2010/082282

PCT Pub. Date: Jul. 22, 2010

(65) Prior Publication Data

US 2011/0304257 A1 Dec. 15, 2011

(30) Foreign Application Priority Data

Jan. 13, 2009 (JP) ..... 2009-004786
Feb. 19, 2009 (JP) ..... 2009-036309

(51) Int. Cl.
*H01J 61/35* (2006.01)
*H01J 17/22* (2012.01)

(52) U.S. Cl. ..... 313/489; 313/636; 313/637; 313/638; 313/485

(58) Field of Classification Search ..... 313/623–627, 313/25, 26.3, 318.01–318.12, 636–638, 489, 313/485; 439/226; 445/22, 26–27
See application file for complete search history.

(56) References Cited

U.S. PATENT DOCUMENTS 6,583,566 B1 * 6/2003 Jin et al. ..... 313/637
2007/0138965 A1 6/2007 Geerdinck et al.

FOREIGN PATENT DOCUMENTS

| | | | |
|---|---|---|---|
| JP | 6100858 | A | 4/1994 |
| JP | 7254390 | A | 10/1995 |
| JP | 7272631 | A | 10/1995 |
| JP | 982280 | A | 3/1997 |
| JP | 2001319619 | A | 11/2001 |
| JP | 2006501619 | A | 1/2006 |
| JP | 2008181780 | A | 8/2008 |

OTHER PUBLICATIONS

English abstract of JP7254390 A.

(Continued)

*Primary Examiner* — Tracie Y Green

(57) ABSTRACT

A fluorescent lamp may include a pair of hot cathode electrodes at both its ends, wherein a phosphor is formed in a laminated manner on the inner surface of a glass tube and a protection film is formed between the glass tube and the phosphor, wherein a residual impure gas in the lamp, including the amount occluded by the phosphor and the protection film, is set to 0.5% or less with the sealed rare gas partial pressure ratio, and wherein the following relationship is fulfilled: $G_{Hg}=A\times C_L$, A=0.0032-0.163 [mg/cc], wherein the amount of sealed mercury is $G_{Hg}$ [mg], the lamp internal volume is $C_L$ [cc], and the coefficient is A [mg/cc].

8 Claims, 4 Drawing Sheets

OTHER PUBLICATIONS

English abstract of JP982280 A.
English abstract of JP20011319619 A.
English abstract of JP6100858 A.
English abstract of JP7272631 A.
English abstract of JP2008181780 A.
Lighting Handbook (2003, 2nd Edition, p. 115, Fig. 2.21) [compiled by the Illuminating Engineering Institute of Japan, published by Ohmsha].

* cited by examiner

FLUORESCENT LAMP AND LIGHTING INSTRUMENT WITH UNSATURATED MERCURY VAPOR THAT ACHIEVES HIGH BRIGHTNESS AND HIGH TEMPERATURES

RELATED APPLICATIONS

The present application is a national stage entry according to 35 U.S.C. §371 of PCT application No.: PCT/TP2009/007304 filed on Dec. 25, 2009, which claims priority from Japanese application No.: 2009-004786 filed on Jan. 13, 2009 and which claims priority from Japanese application No.: 2009-036309 filed on Feb. 19, 2009.

INDUSTRIAL FIELD

The present invention relates to a fluorescent lamp and a lighting instrument using the fluorescent lamp. Particularly, the present invention relates to a technology of preventing a fluorescent lamp from turning off, even when it is lit in a lighting instrument whose lamp containing part has a small volume. Hereinafter, a fluorescent lamp may simply be referred to as a lamp. Further, as one example of a fluorescent lamp, mainly, a compact fluorescent lamp will be explained.

BACKGROUND TECHNOLOGY

Generally, in a fluorescent lamp, a pair of hot-cathode-type electrodes is provided at both ends of the lamp, a phosphor is formed in a layered manner on a surface of a glass tube, and a protective film of, e.g., aluminum oxide is formed between the glass tube and the phosphor layer.

As to the inside of the glass tube, its evacuation is carried out with the entire glass tube being heated during the exhaustion process. In order to enhance the exhaustion efficiency during this exhaustion process, a treatment called "argon flash" is carried out.

The "argon flash" is a method in which argon gas is sealed into the fluorescent lamp during the exhaustion process, residual impure gas occluded by the phosphor and the protective film is heated and discharged into the lamp, and the evacuation is carried out again after diluting the above gas with argon gas. The "argon flash" may be repeated several times.

The "argon flash" allows the residual impure gas to be effectively reduced and the ultimate degree of vacuum inside the glass tube to be increased, both in a limited exhaustion process.

However, since a fluorescent lamp is an industrially manufactured product, it is difficult to bring it to a complete vacuum and the ultimate degree of vacuum (admissible residual gas level) is set within a range where no disturbances occur during the actual use of the lamp. Namely, while it is desirable that the manufacturing process of the fluorescent lamp is carried out in high vacuum, a thus manufactured lamp is very expensive. Thus, the lamp is manufactured with a degree of vacuum where a defect does not occur during the actual use.

If a large quantity of impure gas exists in the discharge space of the glass tube of a fluorescent lamp, the lamp voltage (discharge maintaining voltage) rises and becomes higher than the voltage fed from the lighting circuit, the lamp cannot discharge and extinguishes. This phenomenon is called "turning off".

It is known that the residual impure gas causes the lamp voltage to rise. For example, there has been suggested a technology which applies the turning off phenomenon in that it "incorporates a thin tube made of glass with impure gas sealed inside it" into a part of the arc tube so that, at the end of the lifespan of the fluorescent lamp, the discharging is stopped (see e.g. Patent Document 1).

Another publication describes the phenomenon that the above impure gas has an adverse influence (see e.g. Patent Document 2).

Generally, fluorescent lamps are designed by taking the temperature rise in a lighting instrument into consideration. Thus, fluorescent lamps and the lighting instruments are designed so that, even if the lamp ambient temperature rises, no defect occurs.

Generally, a temperature from 0° C. to 60° C. is described as the expected ambient temperature of the fluorescent lamp, (see e.g. Non-Patent Document 1).

As shown in FIGS. 2 and 12 of Non-Patent Document 1, it has been the technical common knowledge to a person skilled in the art that, at temperatures exceeding room temperature (25° C.), the lamp voltage of a fluorescent lamp drops when the ambient temperature rises.

The inventors have strived for the miniaturization of lighting instruments and examined the combination of a miniaturized compact fluorescent lamp and a miniaturized lighting instrument. Then, the "turning off" phenomenon occurred due to the temperature rise in the lamp and the temperature rise in the lighting instrument. This seemed to be caused by the residual impure gas according to the prior art, and the degree of vacuum was improved during the manufacturing process. However, this level was far higher than the one in the prior art. Even by lowering the residual impure gas concentration, the problem of the turning off was not solved.

When the details of the problem were further examined, it turned out that, though the impure gas was removed, the lamp voltage rose and the turning off occurred when the temperature of the lamp became high. It was found that the cause of this lies in that, in a region with a higher temperature (exceeding 60° C.) than what was described in the above Non-Patent Document 1, there exists a region where the mercury vapor pressure increases and, in conjunction with this, the lamp voltage also increases steeply. Thus, the inventors realized that the phenomenon of the turning off cannot be improved solely by simply removing the impure gas.

Such a phenomenon seemed to become a serious problem, because the environments of use with a rising lamp temperature were expected to increase from then on because of the miniaturization of lighting instruments, use of multiple lamps in downlights (illuminating directly downward with small lights or small light sources embedded in the ceiling, and also used as auxiliary light), or changes in the environments in which the lighting instruments were installed. This phenomenon includes methods of abnormal use, which cause the temperature in a lighting instrument to rise beyond expectation, wherein such an instrument is covered during construction work by a heat insulating material in a space above the ceiling, or the lower surface is shielded by a certain member.

These phenomena are not likely to occur in straight-tube fluorescent lamps which have been mainly used so far. This is because the straight-tube fluorescent lamp has the features that the bulb wall loading is low and the lamp temperature does not easily rise and also because heat is not easily contained in the lighting instrument due to its shape.

A product group of 3U-form single-base fluorescent lamps called FHT, which have been commercialized and, as seen from their past, have a large electric power consumption such as 24 W, 32 W, and 57 W, is expected to increase in the future and has a large bulb wall loading.

Three or four lamps are lit simultaneously in one lighting instrument, and because they are used in downlamps, heat is easily contained in the reflector plate. In some cases, the lighting instrument itself is covered with a heat insulating material during the construction, and the environmental temperature of fluorescent lamps is expected to become higher and higher. As an example of an FHT multi-lamp downlight instrument, four FHT42 lamps are lit simultaneously in the same reflector plate.

The inventors removed the impure gas and experimentally produced many compact fluorescent lamps with impure gas quantities within the range where the rising of the lamp voltage due to the impure gas can be sufficiently restricted even during an operation in a high temperature region. Further, they examined a means for restricting the rising of the lamp voltage accompanying the mercury vapor pressure increase.

As a result, the inventors conceived of utilizing an unsaturated mercury vapor discharging by lighting a mercury vapor in an unsaturated region.

Utilizing an unsaturated mercury vapor discharging has been suggested in the past. As described in Non-Patent Document 1, generally, fluorescent lamps have the problem that the saturated vapor pressure of mercury changes according to the ambient temperature and the change of the mercury evaporation amount causes the discharge characteristic to change, so that the brightness, too, is changed. Here, utilizing the unsaturated mercury vapor discharging is a method suggested for the purpose of obtaining a fluorescent lamp whose brightness does not change according to the ambient temperature.

Concretely, the present invention is intended for solving the problem that the brightness of a fluorescent lamp such as a reading light source of a facsimile changes depending on whether a room temperature is high or low, so that the light receiving quantity of a reading CCD (Charge Coupled Device) changes. It has been suggested to set the amount of mercury sealed into the lamp in such a manner that the mercury in the tube is unsaturated at temperatures below the lower limit of the room temperature (see e.g. Patent Document 3).

In this manner, the mercury in the tube of the fluorescent lamp is unsaturated and completely gasified in the normal-use temperature range. Therefore, no further mercury vapor pressure change occurs and the temperature characteristics of the fluorescent lamp become constant. Thus, there is the advantage that the lamp characteristics do not change in the temperature region normally used. Further, the quantity of the sealed mercury is small.

PRIOR ART DOCUMENTS

Patent Documents

Patent Document 1: JP Pat. Appln. Publ. No. 2008-181780
Patent Document 2: JP Pat. Appln. Publ. No. 7-272631
Patent Document 3: JP Pat. Appln. Publ. No. 2006-501619

Non-Patent Document

Non-Patent Document 1: *Lighting Handbook* (2003, 2nd Edition, page 115, FIG. 2.21) [compiled by the Illuminating Engineering Institute of Japan, published by Ohmsha]

OUTLINE OF THE INVENTION

Problem to be Solved by the Invention

Namely, in the low-pressure mercury vapor discharge lamp in Patent Document 3 above, the quantity of sealed mercury is reduced, and mercury is unsaturated over the entire normal operation temperature range. However, the thus manufactured fluorescent lamp has a very low mercury vapor pressure, and so, regrettably, has a very low emission efficiency as a fluorescent lamp.

The inventors tried to apply the above to realize a lamp which enables the normal efficiency for lighting to be maintained and does not cause the turning off even when a high temperature is reached.

The present invention is realized in order to solve the above problem, and its object is to provide a fluorescent lamp, which does not cause the turning off when the lamp is lit in a high-temperature atmosphere.

Namely, the quantity of mercury to be sealed is specified beforehand, so that in the temperature range of normal use of the fluorescent lamp, a saturated mercury vapor discharge is used, and in a high-temperature region, an unsaturated mercury vapor discharge is used in order to prevent the lamp voltage from rising as if unnecessarily overdriven.

Means for Solving the Problem

The present invention relates to a fluorescent lamp with a pair of hot cathode electrodes at both its ends, wherein a phosphor is formed in a laminated manner on the inner surface of the glass tube and a protection film is formed between the glass tube and the phosphor, characterized in that the residual impure gas in the lamp, including the amount occluded by the phosphor and the protection film, is set to 0.5% or less with the sealed rare gas partial pressure ratio, and the following relationship is fulfilled:

$$G_{Hg}=A\times C_L$$

A=0.032 to 0.163 [mg/cc]

where the amount of sealed mercury is $G_{Hg}$ [mg], the lamp internal volume is $C_L$ [cc], and the coefficient is A [mg/cc].

The fluorescent lamp according to the present invention relates to a fluorescent lamp, wherein, when said fluorescent lamp is lit in a lighting instrument, it is lit at a temperature of the central part of the lamp tube wall exceeding 200° C., characterized in that the residual impure gas in the lamp, including the occluded amount, is set to 0.5% or less with the sealed rare gas partial pressure ratio, and the following relationship is fulfilled:

$$G_{Hg}=A\times C_L$$

A=0.0032 to 0.163 [mg/cc]

where the amount of sealed-in mercury is $G_{Hg}$ [mg], the lamp internal volume is $C_L$ [cc], and the coefficient is A [mg/cc].

The fluorescent lamp according to the present invention fulfills the following relationship:

$$G_{Hg}=A\times C_L$$

A=0.0032 to 0.036 [mg/cc]

where the amount of sealed mercury is $G_{Hg}$ [mg], the lamp internal volume is $C_L$ [cc], and the coefficient is A [mg/cc].

The fluorescent lamp according to the present invention relates to a fluorescent lamp with a pair of hot cathode electrodes at both its ends, wherein a phosphor is formed in a laminated manner on the inner surface of a glass tube, a protection film is formed between the glass tube and the phosphor, and liquid mercury is sealed into the glass tube, characterized in that the residual impure gas in the lamp, including the amount occluded by the phosphor and the protection film, is set to 0.5% or less with the sealed rare gas partial pressure ratio, and the amount of sealed liquid mercury is determined in such a manner that the fluorescent lamp operates with mercury in a saturated vapor pressure state in the normal use temperature range and with mercury in an unsaturated vapor pressure state in a higher temperature region than said use temperature range.

The fluorescent lamp according to the present invention has the feature that the lamp voltage with mercury in the unsaturated vapor pressure state is equivalent to or lower than the lamp voltage in the normal use temperature range.

The fluorescent lamp according to the present invention has the feature that the lamp ambient temperature, where said mercury transitions from the saturated vapor pressure state to the unsaturated vapor pressure state, is 170-200° C. in a lighting state with a horizontal base direction.

The lighting instrument according to the present invention has the feature that several fluorescent lamps as described above are lit in an upward base direction or a horizontal base direction.

Effect of the Invention

By the present invention, the following effect is achieved:

The residual impure gas in the lamp, including the amount occluded by the phosphor and the protection film, is set to 0.5% or less with the sealed rare gas partial pressure ratio and, by fulfilling the following relationship, the lamp turning off does not occur even when the lamp is lit in a high temperature atmosphere:

$$G_{Hg}=A\times C_L$$

A=0.0032-0.163 [mg/cc]

where the amount of sealed mercury is $G_{Hg}$ [mg], the lamp internal volume is $C_L$ [cc], and the coefficient is A [mg/cc].

EMBODIMENT OF THE INVENTION

Embodiment 1

Figure 1:
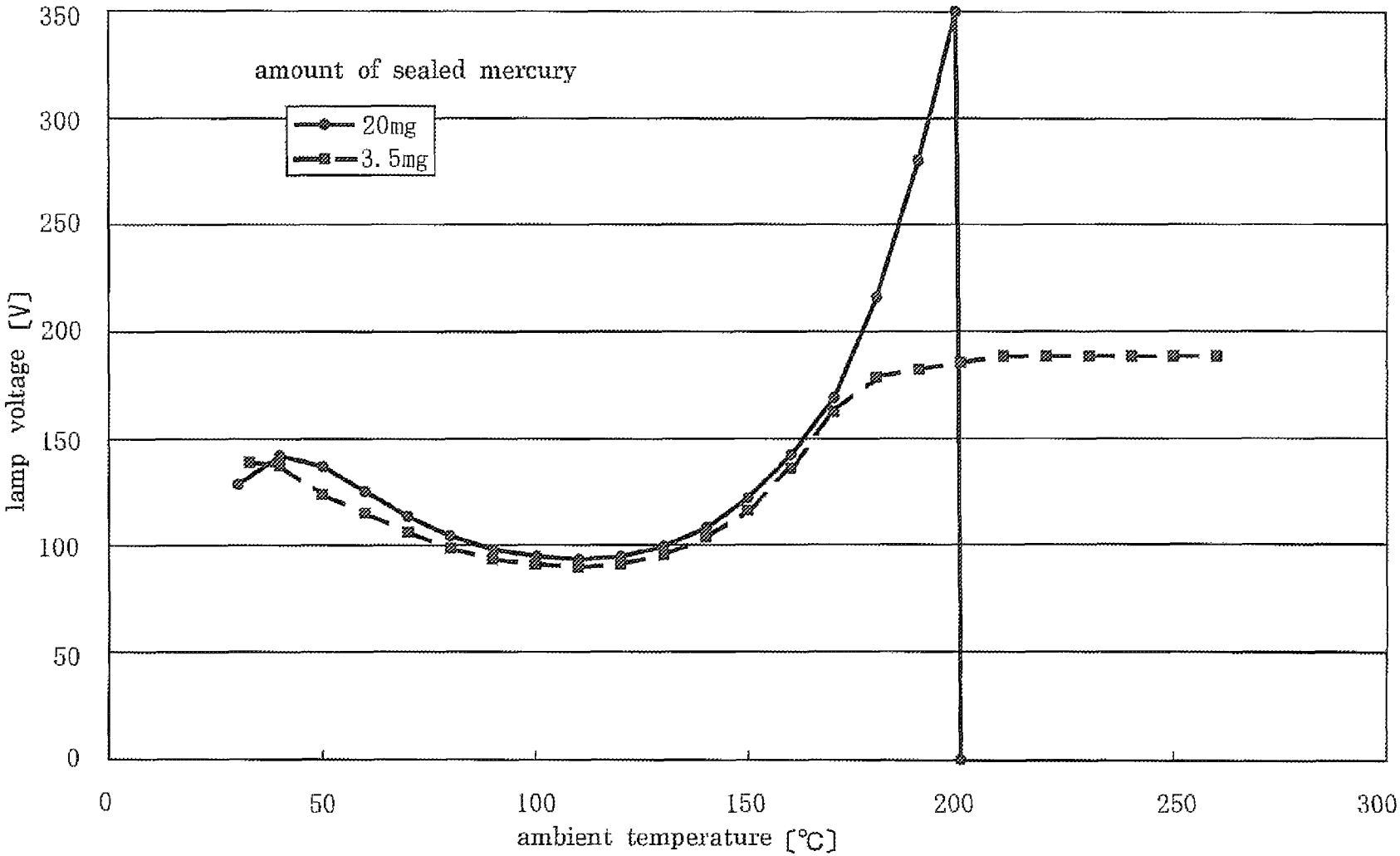
FIG. 1 shows the lamp voltage change with respect to the lamp ambient temperature change between the lamp according to the embodiment of the present invention and the lamp in the comparative example, an FHT42, with the amount of sealed mercury used as parameter.
Figure 2:
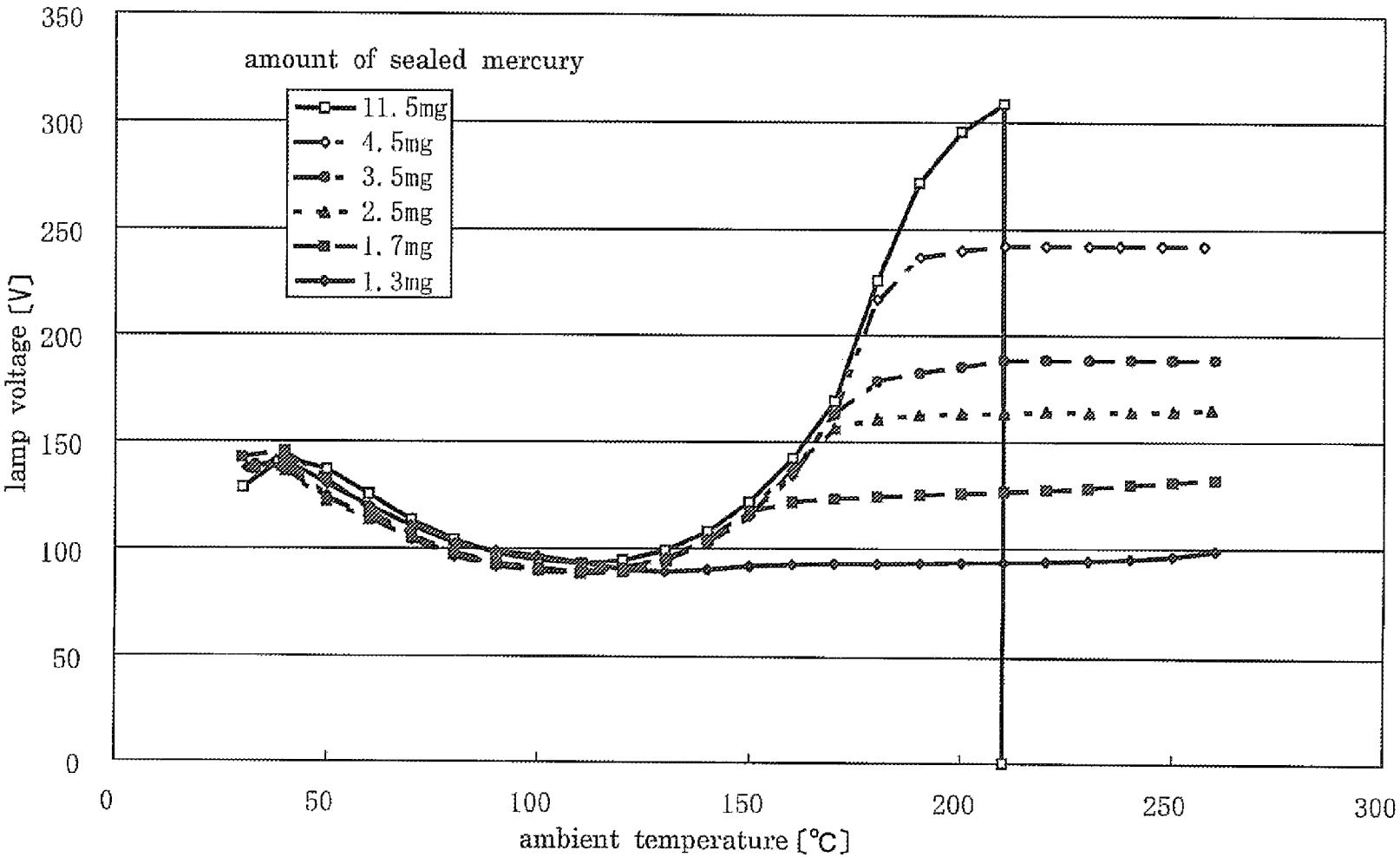
FIG. 2 shows the lamp voltage change with respect to the lamp ambient temperature change between the lamp according to the embodiment of the present invention and the lamp in the comparative example, an FHT42, with the amount of sealed mercury used as parameter.
Figure 3:
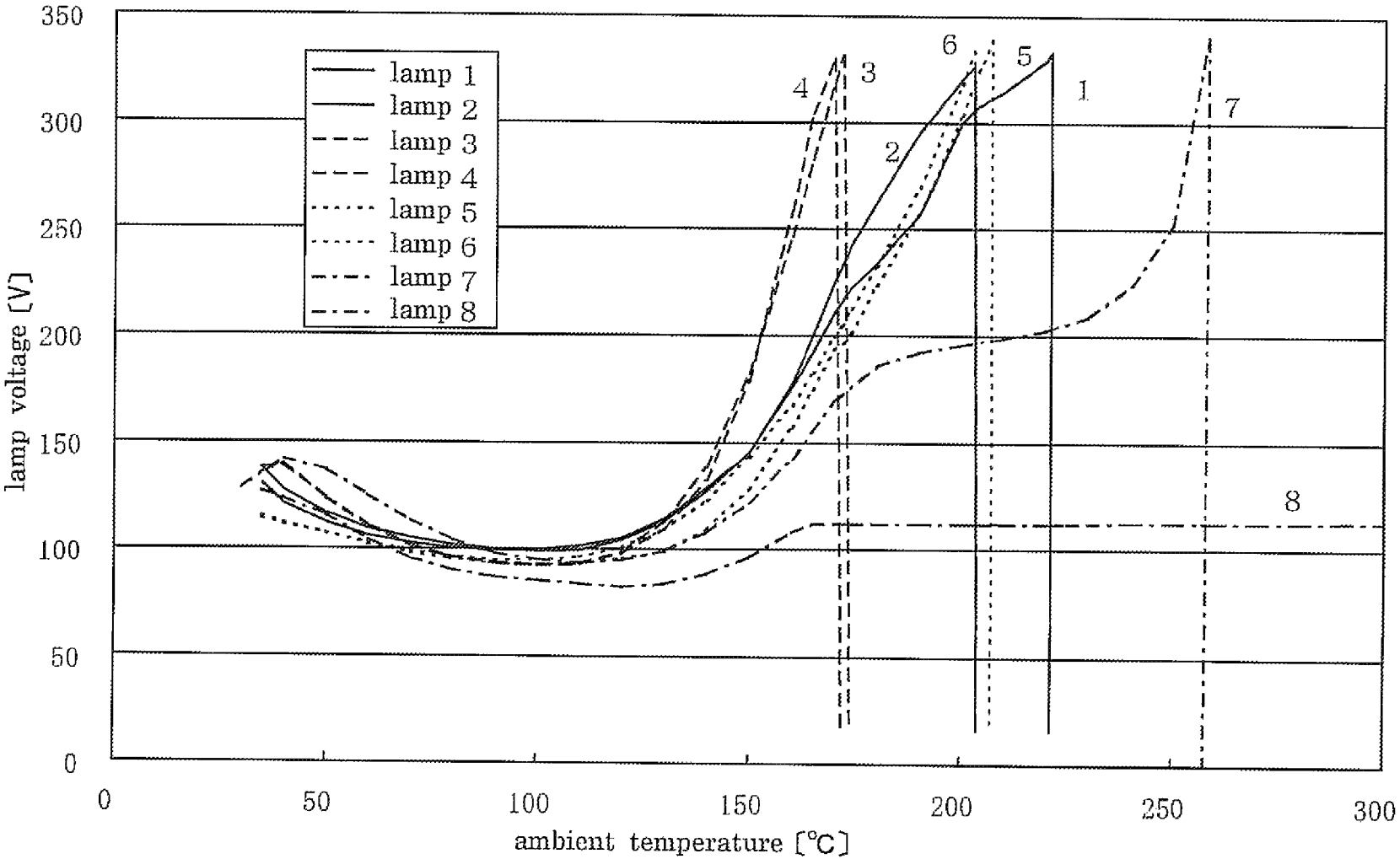
FIG. 3 shows the lamp voltage change in the lamp according to the embodiment of the present invention and the lamps of the comparative example, various kinds of lamps on the market, with respect to the lamp ambient temperature change.
Figure 4:
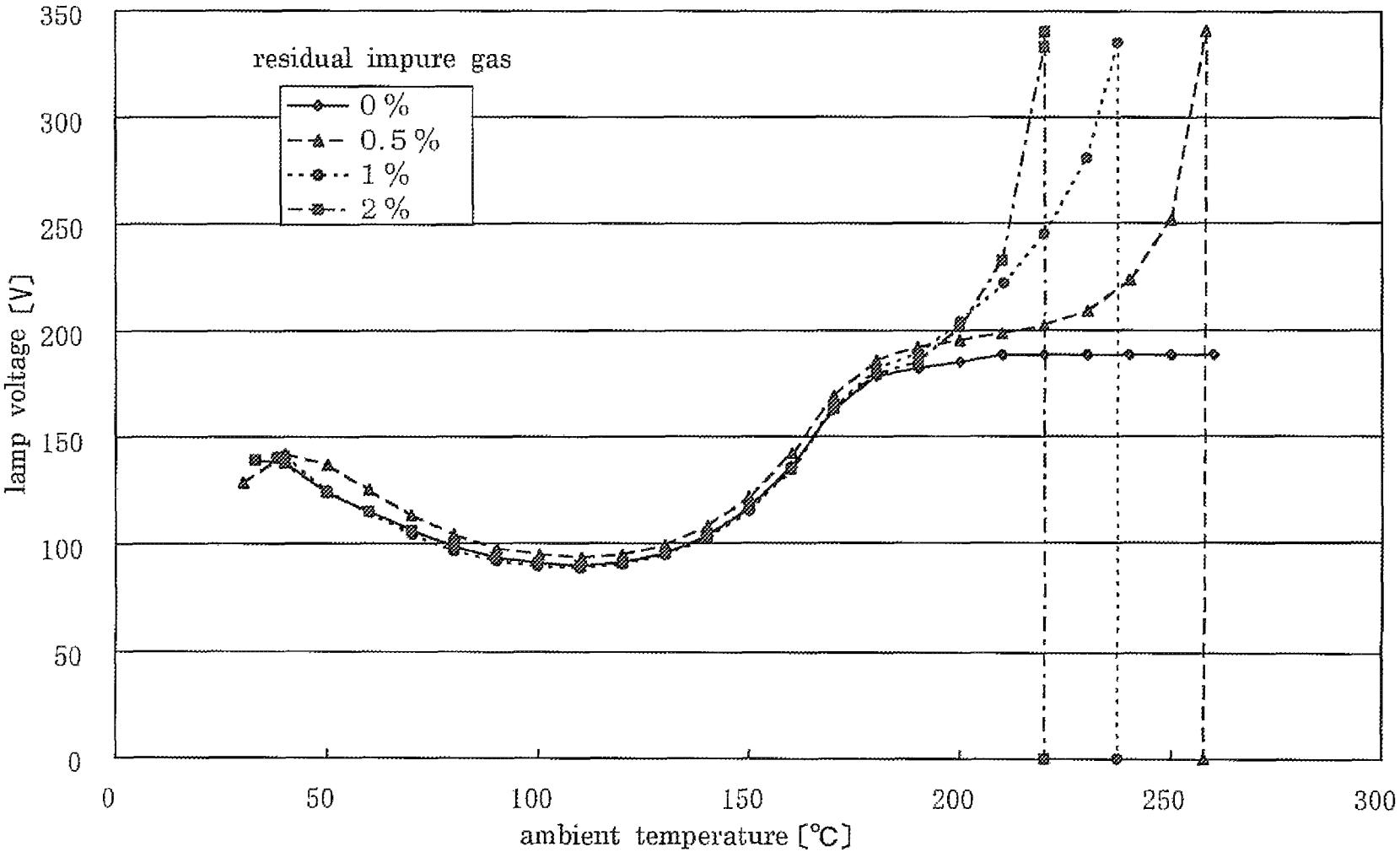
FIG. 4 shows the lamp voltage change with respect to the lamp ambient temperature change between the lamp according to the embodiment of the present invention and the lamp of the comparative example, an FHT42, with the residual impure gas in the lamp used as parameter.

FIGS. 1-4 show the characteristics of the lamp in the present invention and the one in the comparative example. FIGS. 1 and 2 show the lamp voltage change in FHT42 with respect to the lamp ambient temperature change when the amount of sealed mercury is the parameter. FIG. 3 shows the lamp voltage change in various lamps on the market and the lamp in the present invention, with respect to the lamp ambient temperature change. FIG. 4 shows the lamp voltage change in FHT 42 with respect to the lamp ambient temperature when the residual impure gas in the lamp is the parameter.

FHT42 is specified in JIS C7601. The measurement was carried out in conformity with JIS C7601. The prototype was manufactured not in a mass-production facility, but in an exclusive prototype facility where the residual gas amount could be adjusted by varying the exhaust temperature and the time, etc.

In the sample, the portion of the glass tube, which surrounds the discharge in the exhaust process, with the lowest temperature is set to at least 240° C. In case the temperature is less than 240° C., there is the fact that in the practical-use state after completion of the lamp, when the temperature exceeds the one during the exhaust, the impure gas occluded by the phosphor layer, the protection film material and the glass tube is dissociated by the heat and emitted into the discharge space, so that it becomes an impure gas in the discharge space and has an adverse influence.

Further, since the actual mass-produced lamp is manufactured at an industrial speed, it is desirable that the exhaustion is carried out at a higher glass tube temperature. It is important that the temperature is kept high all over the surface surrounding the discharge space. Even if the whole body is hot, in case part of it has a lower temperature, the impure gas is occluded by the low-temperature part and remains in the tube when the lamp is completed.

When the relationship between the ambient temperature and the lamp voltage was measured, the lamp was lit in an airless thermostatic bath with a horizontal base direction. In the measurement method, the lamp ambient temperature was adjusted to the set temperature, the lamp was lit continuously for at least one hour or longer after completion of the temperature rising, and the lamp voltage, etc. was used as measurement value when the lamp characteristics became stable.

The ambient temperature was measured, starting from the low room temperature. When the temperature is gradually raised, impure gas is emitted into the lamp, so that the lamp voltage rises, the lamp characteristic steeply rises as the time elapses without becoming stable, the voltage becomes higher than the voltage that can be supplied from the lighting circuit, and the lamp, unable to maintain the discharging, turns off. The inventors judged it to be preferable for the temperature where the lamp turns off to be high, and they sought a lamp for which said temperature would be higher.

FIG. 1 shows the lamp voltage change with respect to the lamp ambient temperature of FHT42 stipulated presently in the JIS. This lamp (FHT42) has the following features:

(1) Impure gas has been ideally removed as much as possible in accordance with the exhaust conditions;

(2) There are two kinds of amounts of sealed liquid mercury, i.e. 3.5 mg and 20 mg;

(3) A general-purpose high frequency power supply is used for lighting the lamp (power supply used: fluorescent lamp lighting testing device CNF-35399 (manufactured by NF Corporation)); and (4) For controlling the lamp current, the resistance of 420Ω stipulated in the JIS is connected in series with the lamp, thereby to make the lamp current constant, i.e. 320 mA.

Only the thus constricted lamp (FHT42) is put in an oven, and the lamp voltage is measured by changing the lamp ambient temperature.

In FIG. 1, in the lamp of the comparative example with an amount of sealed mercury of 20 mg, the lamp voltage steeply rose at 170° C. or higher and the voltage exceeded the voltage that could be supplied from the high frequency power supply.

Therefore, the discharging could not be maintained and the lamp turned off, so that the subsequent measurement could not be carried out.

In the lamp according to the present invention with an amount of sealed mercury of 3.5 mg, even if the ambient temperature rose, the lamp voltage did not steeply increase and the lamp voltage was below 200V.

For reference, FIG. 2 shows the data for the lamp according to the present invention where the amount of sealed liquid mercury is 1.3 mg, 1.7 mg, 2.5 mg, 4.5 mg, and for the lamp according to the comparative example where the sealed amount is 11.5 mg.

The above turning off of the lamp also occurs in a lighting instrument. Namely, since the output voltage of the lighting circuit is determined, a higher voltage cannot be supplied and the lamp turns off. The output voltage of the lighting circuit is normally about 350V to 400V in case of FHT42. If this voltage were higher, the turning off would not be likely to occur. However, with the sharp lamp voltage rising at about 170° C. taken into consideration, the effect would be very subtle.

In a normal lighting circuit, a lamp voltage rising protection circuit is provided in order to stop oscillation of the lighting circuit due to the voltage rising at the end of the lifespan of the fluorescent lamp.

In case of FHT42, the lamp voltage rising protection circuit is set to about 300V, and its working sometimes causes the lamp to be extinguished. Thus, if FHT42 is used as the example, the lamp extinction does not occur if the lamp voltage can be kept at 300V or lower.

In the case of FHT42, the lamp internal volume is about 70.5 cc. If the amount of mercury to become the saturated mercury vapor pressure during the lighting is calculated at an ambient temperature of 170° C., the result is about 3.5 mg.

When this is generalized, the following relationship needs to be fulfilled:

$$G_{Hg}=A\times C_L$$

A=0.163 [mg/cc]

where the amount of sealed mercury is $G_H$ [mg], the lamp internal volume is $C_L$ [cc] and the coefficient is A [mg/cc].

However, if the amount of sealed mercury is too small, the mercury starts to act under the unsaturated vapor pressure in the expected ambient temperature of 0° C. to 60° C. of a normal fluorescent lamp, as well. Since mercury vapor pressure is very low, as described in Patent Document 2, the emission efficiency, too, becomes very low.

Then, the lower limit of the amount of sealed mercury $G_{Hg}$ needs to be set to prevent mercury from acting under the unsaturated vapor pressure in the expected ambient temperature of 0° C. to 60° C. of a normal fluorescent lamp.

In the case of FHT42, it could be confirmed that, even when the amount of sealed mercury $G_{Hg}$ is 0.14 mg, mercury acts under the saturated vapor pressure state at the commonly known normal use temperature of 0° C. to 60° C.

As to FHT42, in case the amount of sealed mercury $G_{Hg}$ is 0.14 mg, the lamp ambient temperature, at which mercury transfers from the saturated vapor pressure state to the unsaturated vapor pressure state, rises higher than the upper limit, i.e. 60° C., of the normal use temperature in the lighting state in the horizontal base direction.

With the lower limit of the amount of sealed mercury $G_{Hg}$ taken into consideration, the following relational formula is established:

$$G\mathrm{Hg}=A\times CL$$

A=0.0032 to 0.163 [mg/cc]

where the amount of sealed mercury is $G_{Hg}$ [mg], the lamp internal volume is $C_L$ [cc], and the coefficient is A [mg/cc].

Namely, when 3.5 mg of mercury is sealed into the FHT42, even if the ambient temperature reaches 170° C. or higher, there is no liquid mercury present inside the glass tube, the sealed mercury has been completely gasified, which is why the lamp characteristics undergo no change, and thus, the lamp voltage does not rise and the lamp does not turn off.

In the commonly known normal use temperature range of 0° C. to 60° C., mercury does not act under the unsaturated vapor pressure state.

In other words, the amount of sealed liquid mercury is set in such a manner that mercury acts under the saturated vapor pressure state when the fluorescent lamp is in the normal use temperature range and under the unsaturated vapor pressure state when the fluorescent lamp is in a region with a temperature higher than the normal use temperature range.

It is desirable that the lamp voltage in the unsaturated vapor pressure state of mercury is equal to or lower than the lamp voltage in the normal use temperature range.

In this case, it is assumed that the lamp ambient temperature, in which mercury transfers from the saturated vapor pressure state to the unsaturated vapor pressure state, is 170 to 200° C. in the state of the horizontal base direction.

Ideally, in a state without impure gas, and in case the amount of mercury, with which the lamp does not turn off, fulfills the above relationship, the lamp voltage, as shown in FIG. 2, becomes stable at a high level as the amount of mercury increases. This state is not preferable because it is a burden on the lighting circuit. Thus, in a lamp in which mercury becomes unsaturated because of a rising ambient temperature, it is desirable that the voltage is at the voltage level at a low ambient temperature or lower.

When this is generalized, the following relationship needs to be fulfilled:

$$G_{Hg}=A\times C_L$$

A=0.0032 to 0.036 [mg/cc]

where the amount of sealed mercury is $G_{Hg}$ [mg], the lamp internal volume is $C_L$ [cc], and the coefficient is A [mg/cc].

FIG. 3 shows the result of research as to whether or not lamps with the same features as those of the above lamp are on the market. In the present measurement, a lighting circuit for use in a normal lighting instrument is used to light the lamp. Therefore, as shown in FIG. 3, in the Lamps 1-6, which are on the market in Japan, the lamp voltage steeply rises at an ambient temperature of about 170 to 225° C. Therefore, the lamp voltage rising protection circuit is operated and the lamp extinguishes.

In the Lamps 3 and 4, a large amount of residual impure gas was contained and the runaway of the lamp voltage was immediately observed in the high-temperature range.

As to the lamps besides the Lamps 3 and 4 among the Lamps 1-6, when the ambient temperature was raised, the lamp voltage rising protection circuit was activated by the lamp voltage rising due to the impure gas, before the mercury vapor pressure became unsaturated, and the lamp extinguished.

The Lamp 7 according to the present invention, which is used at temperatures not exceeding 250° C., has residual impure gas in a percentage of about 0.5% and an amount of sealed mercury of 3.5 to 4.5 mg. Thus, the ambient temperature at which the lamp voltage rises is higher than those of the Lamps 1-6.

In FIG. 3, the Lamp 8 is a sample based on the invention by the inventors. In this lamp, the amount of the impure gas is 0.5% or less and the amount of sealed mercury is 1.5 mg.

The amount of the impure gas is set to 0.5% or less and the amount of sealed mercury is set to 1.5 mg. As a result, it could be confirmed that, in the Lamp 8, mercury sealed at an ambient temperature of about 170° C., is completely gasified, the characteristics undergo no change, the lamp voltage becomes constant, and the lamp does not turn off.

Next, FIG. 4 shows the lamp voltage change with respect to the lamp ambient temperature change of FHT42 in the case where the residual impure gas in the lamp is used as parameter. In case of the lamp according to the present invention, which has a residual impure gas in the lamp of 0.5% or less, a steep rising of the lamp voltage is not recognized unless the lamp ambient temperature exceeds 250° C. Thus, it is clear that the residual impure gas in the lamp, including the amount occluded by the phosphor and the protection film, needs to be set to 0.5% or less with the sealed rare gas partial pressure ratio.

As explained above, there are two kinds of steep rising of the lamp voltage. One is caused by the impure gas discharged into the lamp.

The other is the phenomenon where the temperature of the lamp itself rises as the ambient temperature rises, and the mercury vapor pressure increases because of the rising of the lamp cold spot temperature, so that the lamp voltage rises. Generally, this is not known to a designer of a fluorescent lamp.

As to these two points, measurements concerning the lamps, including the product by the present inventors, were carried out by the respective makers, and the turning off of the lamp, which normally occurs due to the emission of impure gas, occurred at a lower ambient temperature. Thus, it was confirmed that, though the amount of sealed mercury was reduced, the turning off of the lamp could not be evaded.

If the amount of impure gas is reduced (0.5% or less) and the amount of sealed mercury is decreased (1.5 mg), it is possible to realize a fluorescent lamp that does not turn off, even when it is lit at a high-temperature atmosphere.

The explanation has been made mainly in connection with FHT42, but in view of the above-explained principle, it should be understood that the present invention can be applied to other fluorescent lamps. However, in fluorescent lamps, which are not compact type, the defect of the turning off of the lamp in a high temperature range does generally not actually occur due to the magnitude of the instrument internal volume and the heat dissipation of the temperature in the instrument.

The present invention can naturally be applied to a bulb-type fluorescent lamp with an arc tube, which is covered with an outer tube globe and becomes very hot.

The use of the thus designed fluorescent lamp prevents the turning off of the fluorescent lamp from occurring, even if the lighting instrument is placed in an unexpected environment, and can also contribute to miniaturization.

While the amount of the residual impure gas is 0.5% or less in the present invention, almost all of it is occluded by the phosphor layer and the protection film material, and it is difficult to carry out the measurement. We calculated this value by heating the glass tube as well at a high temperature and measuring the amount of the impure gas. Generally, when the correlation between the ambient temperature and the lamp voltage is measured and represented in a graph (see FIG. 4), cases where the lamp voltage steeply rises with the inflection point at about 220° C. or lower correspond to the above value.

Thus, measuring the impure gas amount and confirming that the impure gas amount is larger than 0.5% is equivalent to the feature that the lamp voltage rising by the ambient temperature occurs at 220° C. or lower under the lighting state in the horizontal base direction. Accordingly, it seems that lamps with the lamp voltage runaway at 220° C. or lower have a residual impure gas amount of 0.5% or less. Since the measurement of the residual impure gas amount varies depending on the apparatus and method for measurement, according to the purpose of the present invention, the voltage rising at 220° C. or lower is suitable as specifying the impure gas amount.

Recently, in order to reduce the burden on the environment, activities of reducing the amount of sealed mercury in fluorescent lamps have been carried out based on RoHS, etc.

RoHS is a directive by the European Union (EU) relating to the limitation of the use of specific hazardous substances in electronic/electric equipment. In February 2003, it was issued together with the WEEE Directive and was put into effect in July 2006.

According to the present stipulation of RoHS, in case of a compact type, the amount of sealed mercury is less than 5 mg. However, as explained above, the purpose of the present invention is to restrict the turning off of a lamp due to the mercury vapor pressure rising in a high temperature range and the steep rising of the lamp voltage because of the impure gas emission. Therefore, needless to say, the objects are different from each other. Further, the impure gas is not specified in RoHS.

In case the tube wall temperature does not exceed 200° C. or the lamp power does not exceed 24 W, the residual impure gas was occluded during the normal production by the phosphor layer and was not emitted into the discharge space. Thus, the turning off of the lamp did not occur. The number of multi-lamp instruments is small for lighting instruments, so that no problem is caused in conventional lamps.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A fluorescent lamp, comprising:

a pair of hot cathode electrodes at both its ends, wherein a phosphor is formed in a laminated manner on the inner surface of a glass tube and a protection film is formed between the glass tube and the phosphor, wherein a residual impure gas in the lamp, including the amount occluded by the phosphor and the protection film, is set to 0.5% or less with the sealed rare gas partial pressure ratio, and wherein the following relationship is fulfilled:

$$G_{Hg}=A\times C_L$$

A=0.0032-0.163 [mg/cc]

wherein the amount of sealed mercury is $G_{Hg}$ [mg], the lamp internal volume is $C_L$ [cc], and the coefficient is A [mg/cc].

2. A fluorescent lamp, configured such that, when said fluorescent lamp is lit in a lighting instrument, the temperature of a central part of a lamp tube wall exceeds 200° C., wherein the residual impure gas in the lamp, including the occluded amount, is set to 0.5% or less with the sealed rare gas partial pressure ratio, and the following relationship is fulfilled:

$G_{Hg}=A\times C_L$

A=0.0032 to 0.163 [mg/cc]

wherein the amount of sealed mercury is $G_{Hg}$ [mg], the lamp internal volume is $C_L$ [cc], and the coefficient is A [mg/cc].

3. The fluorescent lamp according to claim 1, wherein the following relationship is fulfilled:

$G_{Hg}=A\times C_L$

A=0.0032 to 0.036 [mg/cc]

where the amount of sealed mercury is $G_{Hg}$ [mg], the lamp internal volume is $C_L$ [cc], and the coefficient is A [mg/cc].

4. A fluorescent lamp, comprising:

a pair of hot cathode electrodes at both its ends, wherein a phosphor is formed in a laminated manner on the inner surface of a glass tube, wherein a protection film is formed between the glass tube and the phosphor, and wherein liquid mercury is sealed into the glass tube, wherein the residual impure gas in the lamp, including the amount occluded by the phosphor and the protection film, is set to 0.5% or less with the sealed rare gas partial pressure ratio, and wherein the amount of sealed liquid mercury is determined in such a manner that the fluorescent lamp operates with mercury in a saturated vapor pressure state in a normal use temperature range and with mercury in an unsaturated vapor pressure state in a higher temperature region than said use temperature range.

5. The fluorescent lamp according to claim 4, wherein the lamp voltage with mercury in the unsaturated vapor pressure state is equivalent to or lower than the lamp voltage in the normal use temperature range.

6. The fluorescent lamp according to claim 4, wherein the lamp ambient temperature, wherein said mercury transitions from the saturated vapor pressure state to the unsaturated vapor pressure state, is 170 to 200° C. in a lighting state with a horizontal base direction.

7. A lighting instrument, comprising:

a plurality of fluorescent lamps, each fluorescent lamp comprising:

a pair of hot cathode electrodes at both its ends, wherein a phosphor is formed in a laminated manner on the inner surface of a glass tube and a protection film is formed between the glass tube and the phosphor, wherein a residual impure gas in the lamp, including the amount occluded by the phosphor and the protection film, is set to 0.5% or less with the sealed rare gas partial pressure ratio, and wherein the following relationship is fulfilled:

$G_{Hg}=A\times C_L$

A=0.0032-0.163 [mg/cc]

wherein the amount of sealed mercury is $G_{Hg}$ [mg], the lamp internal volume is $C_L$ [cc], and the coefficient is A [mg/cc], wherein the plurality of fluorescent lamps are lit in an upward base direction or a horizontal base direction.

8. The fluorescent lamp according to claim 2, wherein the following relationship is fulfilled:

$G_{Hg}=A\times C_L$

A=0.0032 to 0.036 [mg/cc]

where the amount of sealed mercury is $G_{Hg}$ [mg], the lamp internal volume is $C_L$ [cc], and the coefficient is A [mg/cc].

* * * * *